United States Patent [19]

Nakanishi

[11] 4,072,039

[45] Feb. 7, 1978

[54] METHOD FOR FORMING COUNTER-SUNK HOLE IN A BASE MATERIAL AND AN APPARATUS FOR CARRYING OUT THE SAME

[76] Inventor: Yoshitaka Nakanishi, 12-9, Yawata 5-chome, Ichikawa, Chiba, Japan

[21] Appl. No.: 747,187

[22] Filed: Dec. 3, 1976

[30] Foreign Application Priority Data

Apr. 30, 1976 Japan ..... 51-48516

[51] Int. Cl.[2] ..... B21D 28/26

[52] U.S. Cl. ..... 72/334; 72/335

[58] Field of Search ..... 72/337, 334, 335, 336, 72/273, 359, 479

[56] References Cited

U.S. PATENT DOCUMENTS

| | | | |
|---|---|---|---|
| 1,695,476 | 12/1928 | Winkler | 72/334 |
| 2,453,762 | 11/1948 | Schwartz | 72/334 |
| 3,280,613 | 10/1966 | Schrom | 72/359 |

*Primary Examiner*—Lowell A. Larson

*Attorney, Agent, or Firm*—Robert E. Burns; Emmanuel J. Lobato; Bruce L. Adams

[57] ABSTRACT

Counter-sunk seats are formed around preliminary holes in a work piece. Material of the work piece is thereby forced into the preliminary holes, and extruded through the preliminary holes, while other material of the work piece is extruded into a slit, previously formed in the work piece adjacent the preliminary holes, preventing undesirable swelling of the work piece.

10 Claims, 7 Drawing Figures

METHOD FOR FORMING COUNTER-SUNK HOLE IN A BASE MATERIAL AND AN APPARATUS FOR CARRYING OUT THE SAME

BACKGROUND OF THE INVENTION

The present invention relates to a method for forming counter-sunk seats around holes perforated in a base material and also relates to an apparatus for carrying out the method.

It has hitherto been known to form counter-sunk seats around holes in a base material by means of a metal machining process or a press-working process, and it has also been noticed that the latter or press-working process is more efficient than the former or machining process.

The press-working process has defects in the forming counter-sunk seats. The base material tends to expand radially of the counter-sunk seats as a result of the compression of the base material. The resulting swelling around the counter-sunk seat results in a finished product or merchandise of low or zero utility and strength. Another trouble of the radial expansion is that, in case of forming counter-sunk hole in a long unit of base material which is fed consecutively to a working spot, the dimension of elongation caused by expansion of the material along a feeding direction is added to the original length of the material so as to cause difficulties in forming counter-sunk holes at a correct positions.

SUMMARY OF THE INVENTION

An object of the present invention is to provide a method for forming precisely counter-sunk holes by means of a press-working process at predetermined spots, which enables minimizng the swelling dimensions around counter-sunk holes and the elongation in a radial direction in the course of the counter-sinking stage, as well as obtaining a product of such strong and good quality as to be highly valuable as a merchandise.

Another object of the present invention is to provide a method for simply forming counter-sunk holes in a very hard base material such as a stainless steel sheet and the like.

A further object of the present invention is to provide a method for feeding successive portions of a unitary body or strip to a correct working spot for successive countersinking without imparting elongation by one countersunk portion to another portion to be countersunk in producing an array of such portions.

Still another object of the present invention is to provide an apparatus capable of attaining the foregoing objects.

According to the present invention, a counter-sunk seat is formed around a preliminary hole previously perforated in a base material by a punching, the seat being formed by compressing a top edge portion of the material surrounding the preliminary hole with a worktool at a conical working surface thereof so as to flow the compressed portion of the worked material into the preliminary hole. A counter-sunk hole of better quality and more strengthened formation can be obtained by making a finished hole around the preliminary hole by punching the fractional portion of the worked material which is flown into the preliminary hole, after compressing the top edge of the preliminary hole into the conical form, without the longitudinal swelling.

The foregoing objects and other objects as well as features of the present invention will be clarified through the description given hereinafter with reference to the accompanying drawings by way of example in a form of embodiment of the invention.

DESCRIPTION OF THE PREFERRED EMBODIMENTS

Figure 1:
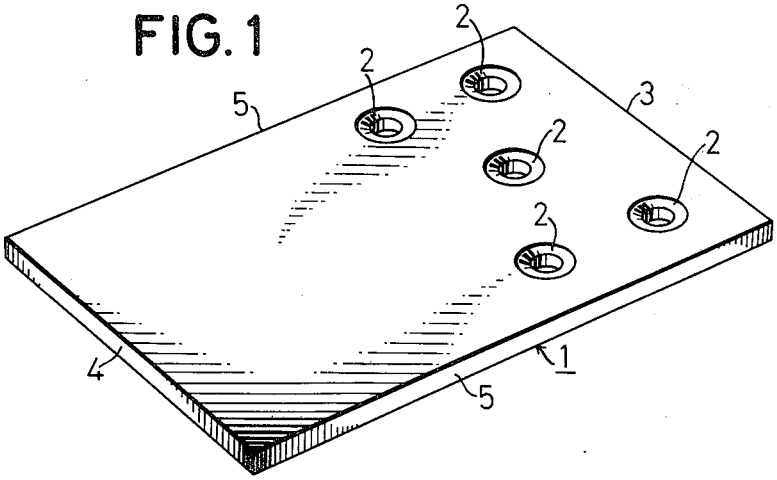
FIG. 1 is a perspective view of a metal sheet for a hinge having a plurality of counter-sunk holes formed therein by the new method.

There are many kinds of material to be provided with counter-sunk holes therein, and in FIG. 1, a unit or sheet of base material is shown as an example to be used for making a wing of a hinge. The base material unit 1 is a rectangular stainless steel sheet having a plurality of counter-sunk holes 2 in its surface adjacent one end or edge 3 of the sheet while the other portion thereof, adjacent end or edge 4, has no counter-sunk hole therein; this other portion being subsequently bent by a conventional process to form a tubular portion, not shown, for receiving the axis of a hinge therein.

When counter-sunk holes 2 are perforated by the known, compressive, press-working process, the dimension between adjacently disposed counter-sunk holes is elongated, as mentioned hereinbefore. Thus the distance between the correlative holes is disarranged, and also the length of the unit of base material, from one edge 3 to a successive edge 4 in the feeding direction of the material is elongated; therefore when making successive units of base material out of a long strip of material, thereby it is very difficult to precisely supply the unitary base material to a correct working spot.

The step of process according to the invention solves this problem. The steps of process for forming a counter-sunk hole are set forth as follows.

Figure 2:
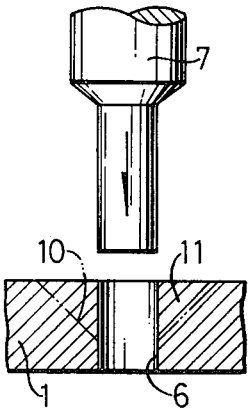
FIG. 2 to FIG. 4 are schematic sectional side views showing successive steps of the new method.

In the first place, a preliminary hole 6 is perforated in a base material 1 by use of a die 7 for punching the perforation (refer to FIG. 2).

Figure 3:
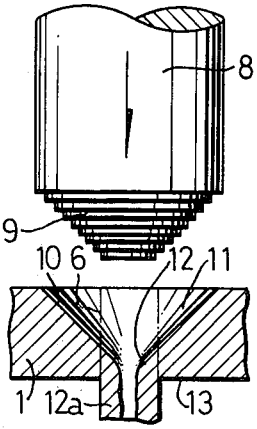

In the next place, by pressing a fraction 11 of material surrounding the punched preliminary hole 6, at its top edge or end downward with a beveling punch die 8 having a generally conical working surface 9, a conical counter-sunk seat 10 is formed at the top end of the preliminary hole 6 (refer to FIG. 3). The fraction 11 of the worked material at the edge portion of the preliminary hole is pressed by the beveling die surface 9, downward into the preliminary hole 6, and a part 12*a* of the pushed-down fraction 12 is forced out of the lower surface 13 of the sheet, through the preliminary hole. As a result of the foregoing working process, even a very hard base material such as a stainless steel sheet can simply be provided with a counter-sunk hole 2 thereon. At the same time, the swelling phenomenon which previously occurred at the edge portion around a counter-sunk seat in the worked base material, can be strictly controlled to reduce it to a minimum dimension whereby also the elongation of the worked base material in the direction of the surface plane thereof is controlled and minimized. Thus the counter-sunk hole 10,12 can precisely be formed at a predetermined spot while a product of strengthened and excellent quality and a product highly valuable as merchandise can be obtained.

Figure 5:
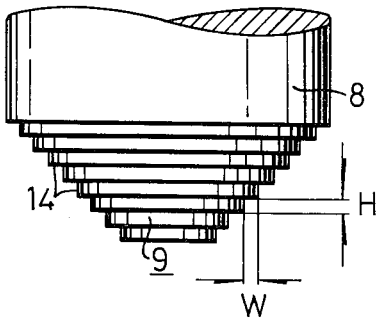
FIG. 5 is a fractional front view of a punch for counter-sinking work according to the present invention.

The conical working surface 9 of the beveling punch die 8 may be formed in a serrated form or with annular stepped shoulders 14 as shown in FIG. 5, and the material surrounding the preliminary hole 6 is pressed downward at the top edge portion 11 thereof by means of the shoulder 14 in a serration shape. The pressed edge portion 11 is displaced much more smoothly toward the inner part of the preliminary hole 6 as compared with the process of compressing with the conical working smooth surface of a plain beveling punch die. The shoulder 14 in serration shape is formed in a spiral or non-spiral shape, which can readily be made by a lathe. The width W as well as the height H of the shoulder 14 is defined by the base angle of the cone; the width and the height turn out to be equal in dimension when this angle is 45°. The absolute dimensions of the shoulder 14 may be varied, depending on the base material to be worked and, for example, when a stainless steel sheet is employed, H and W are properly within the range from about 0.05 mm to about 0.3 mm.

Figure 4:
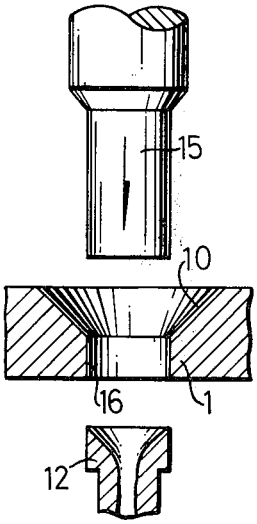

Further, as shown in FIG. 4, the compressed base material in and directly around the edge portion of the preliminary hole 6 is perforated by use of a die 15 for punching a finished hole so as to form a finished hole 16 concentric with the preliminary hole 6. By means of punching work for forming the finished hole 16, the fraction 12 forced down into the preliminary hole 6 is removed. The diameter of the finished hole 16 may be equivalent in dimension to that of the preliminary hole 6 for shearing only the fraction 12 forced out into the preliminary hole 6, or the diameter of the finished hole 16 may be made larger than that of the preliminary hole 6 to punch the edge portion of the preliminary hole 6 together with the forced-out fraction 12.

Since the counter-sunk seat 10 is formed on the top end of the previously perforated preliminary hole 6, by forcing the fraction staying around the preliminary hole 6 to be displaced into the preliminary hole, the distance between the center of adjacently disposed, resulting counter-sinks is kept constant, as set forth hereinbefore, and as the finished hole 16 is punched after forming the counter-sunk hole, the center of the finished hole 16 can easily be aligned with the center of the counter-sunk surface 10, so that the center of the finished hole 10, 16 can be positioned precisely in accordance with the specifications or plan.

As shown in FIGS. 2 to 4, the original surfaces of the plate-like base material remain substantially unchanged in the punching and compressive operations according to the invention.

Figure 6:
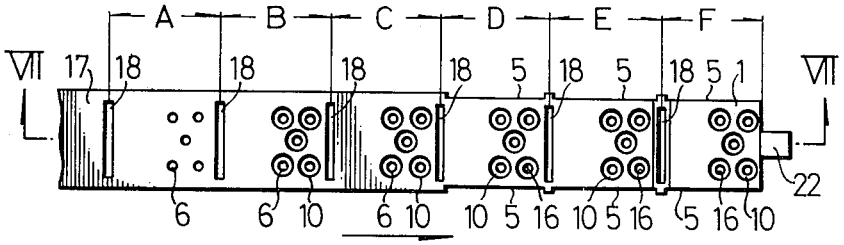
FIG. 6 is a schematic plan view of consecutive steps for forming hinge wings having perforated counter-sunk holes from a strip-like base material according to the method of the present invention.
Figure 7:
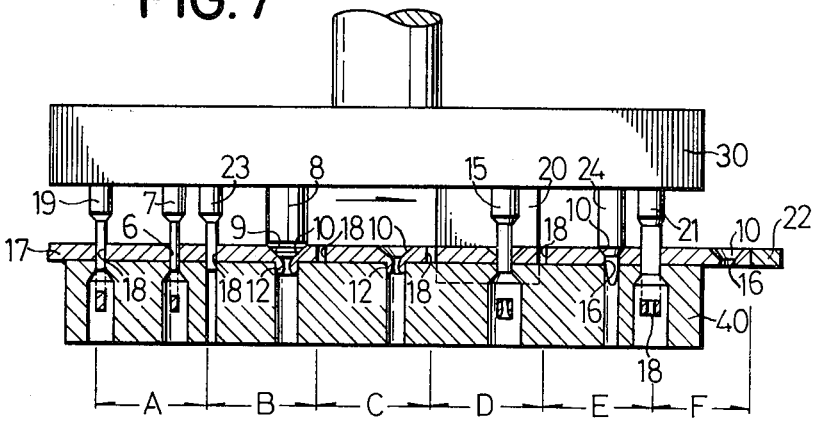
FIG. 7 is a sectional view taken along the line VII — VII of FIG. 6, also showing a punch device used in carrying out the method.

In FIG. 6 and FIG. 7, there is shown a method for forming consecutively sheets or a units 1 of base material having a plurality of counter-sunk holes therein out of a strip-like base plate by way of an example.

A strip 17 of material is fed to a press-working device comprising a punch holder 30 and dies 40. The strip 17 is fed in sequence by a feeding pitch corresponding to the length of a unit 1 for each stroke of the punch holder or press ram.

At first, the strip 17 is perforated to form concurrently a slit 18 and preliminary holes 6 therein at a working spot A on die 40 under respective punching dies 19 and 7 on holder 30. On the other hand, a process for first punching the slit 18 and subsequently the preliminary holes 6 may be carried out, instead of the aforementioned process for punching concurrently both the slit 18 and preliminary holes 6, or a process with steps reverse to the foregoing may be carried out.

Secondly, when the slit 18 and preliminary holes 6 reach the working spot B by feeding the strip 17 by one pitch of distance according to the punching work, the strip 17 is held at a correct position by inserting a pilot pin 23 into the slit 18. And at the same time, counter-sunk seats 10 are formed on the top ends of preliminary holes 6 by use of a punching die 8 for beveling in a conical-shape. In this step, the fraction 11 at the beveled portion of the base material compressed by the punching die 8 is flown out into a preliminary hole 6. As the counter-sunk seat 10 is formed on the top edge of the preliminary hole 6 after the slit 18 having been punched, even though the base material 17 is elongated slightly in a longitudinal direction in the course of forming the counter-sunk seat by compressing the base material surrounding the preliminary hole 6 at the top edge thereof, the elongation is absorbed into the slit 18. Accordingly, the distance between the slits 18 corresponding to the feeding pitch is maintained constantly and the feeding pitch for the base material 17 can be kept correctly. As a result, the center of the preliminary hole 6, of the counter-sunk seat 10, and of the finished hole 16 are aligned with one another without any disalignment, thus the counter-sunk hole can be punched accurately as indicated by the specifications and the plan.

As illustrated, the strip 17 is fed by one feeding pitch, and the counter-sunk seat 10 reaches the spot C where no press operation is performed.

In a subsequent step, the strip 17 is fed by a feeding pitch and the counter-sunk seat 10 reaches the working spot D where the top edge fraction pressed into the preliminary hole 6 is perforated by a punch 15 so as to form a finished hole 16 around the preliminary hole 6. At the same time, the base material 17 is cut off at both sides 5 thereof by an edging punch 20 for bringing to completion. However, a process of punching the finished hole 16 and thereafter cutting off both sides 5 of a unitary base strip may be carried out in place of the process for punching the finished hole 16 and cutting off both sides 5 concurrently.

In a further step, the base plate 17 is fed by one pitch and the finished hole 16 comes to the working spot E, then the pilot pin 24 is inserted into the finished hole 16 to fix the base material securely at a correct position, and the base material strip 17 so fixed and located, is cut off at the right end thereof by a shearing punch 21 to separate the preceding unit 1 from the strip-like base material 17.

When the strip 17 is fed further by one pitch, the end surface of the cut-out unit 1 runs against gauge plate 22 and the finished hole 16 comes to the working spot F where the base material is cut off at the left end of the unit 1 by the shearing punch 21.

Each of the punching dies employed in the foregoing steps of process is fixed to a punch holder 30 to be actuated integrally with one another in a vertical movement. All the steps of the above-mentioned process from a step of punching a first slit 18 to a step of shearing the last unit 1 by one stroke of a press ram are carried out simultaneously, whereby a unit 1 provided with counter-sunk holes 10,16 (FIG. 6) is produced efficiently in the course of one stroke of a press ram.

The present invention is described as applied to the production of a hinge, to provide one embodiment, however, the present invention is not limited only to the foregoing hinge, but is able to be applied to the production of articles provided with counter-sunk holes such as, for instance, fitting seats to serve as an attachment to door catches, handles, latches, door stops, side dump door stoppers and the like as well as flat-bars to be attached to furniture, fittings of a house and the like.

What is claimed is:

1. A method of producing counter-sunk holes in a plate-like base, comprising the steps of; punching preliminary holes through a plate-like base; counter-sinking a seat around one end of and coaxially with each preliminary hole by compressing base material surrounding said end of the preliminary hole to force portions of said material into the preliminary hole and out of another end of the preliminary hole while keeping the base plate-like and otherwise avoiding deformation of surfaces of the plate-like base; and punching a finishing hole coaxially with the countersunk seat and preliminary hole to remove portions of base material forced into the preliminary hole.

2. A method of producing countersunk holes in a strip of base material, comprising the steps of; performing intermittent longitudinally movements of a strip of base material over a press-working spot with a feeding pitch controlled to register longitudinally successive; uniformly spaced apart portions of the strip with the press-working spot; upon each such movement punching a transverse slit into the strip and punching a preliminary hole into the strip adjacent the slit; and thereupon countersinking a seat around one end of and coaxially with the preliminary hole by compressing base material surrounding said end to force portions of such material thereof into the preliminary hole.

3. A method according to claim 2 additionally including the step of punching a finishing hole coaxially with each preliminary hole to remove the base material force into the preliminary hole.

4. A method according to claim 2, additionally including the step of shearing base material from side portions of the strip, and thereby dividing the strip into separate portions at each slit.

5. Apparatus for producing countersunk holes in a plate-like base material, comprising:

a press-working die; a press-tool unit movably disposed opposite the die to permit feeding a plate-like base material to successive positions between and relative to the die and the tool unit; a punch on the tool unit for punching a preliminary hole through the base material; and compressing means on the tool unit for countersinking a seat around one end of the preliminary hole by compressing base material surrounding said end to force portions of such material into the preliminary hole, while substantially avoiding deformation of surfaces of the plate-like base material.

6. Apparatus according to claim 5, in which the compressing means defines a generally conical working surface having a plurality of coaxial annular shoulders.

7. Apparatus according to claim 5, in which the press-tool unit additionally includes a punch for punching a finishing hole through the base material coaxially with the countersunk seat.

8. Apparatus for producing countersunk holes in a plate-like base material, comprising:

a press-working die; a press-tool unit movably disposed opposite the die to permit feeding a strip-like base material to successive positions between and relative to the die and the tool unit; punches on the tool unit for punching a slit transverse of the base material, and a preliminary hole, through the base material; and compressing means on the tool unit for countersinking a seat around one end of the preliminary hole by compressing base material surrounding said end to force portions of such material into the preliminary hole.

9. Apparatus according to claim 8 in which the press-tool unit additionally has shear means thereon for shearing side portions from the base material, across the slit.

10. Apparatus according to claim 8 in which the press-tool unit additionally has a punch for punching a finishing hole through the base material coaxially with the countersunk seat.

* * * * *